US009993929B2

(12) United States Patent
Van Der Vlis et al.

(10) Patent No.: US 9,993,929 B2
(45) Date of Patent: Jun. 12, 2018

(54) CARRIER FOR A SHAVING DEVICE, COMPRISING PAIRS OF A CUTTING ELEMENT AND A HAIR LIFTING ELEMENT

(75) Inventors: Peter Hans Van Der Vlis, Drachten (NL); Paul-Rainer Viktor Karl Slesazeck, Bovensmilde (NL); Gert Niers, Westerbork (NL); Erik Houbolt, Singapore (CN)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 966 days.

(21) Appl. No.: 13/256,817

(22) PCT Filed: Mar. 23, 2010

(86) PCT No.: PCT/IB2010/051252

§ 371 (c)(1),
(2), (4) Date: Sep. 15, 2011

(87) PCT Pub. No.: WO2010/113068

PCT Pub. Date: Oct. 7, 2010

(65) Prior Publication Data

US 2012/0011724 A1 Jan. 19, 2012

(30) Foreign Application Priority Data

Mar. 30, 2009 (EP) ..... 09156576

(51) Int. Cl.

| | |
|---|---|
| ***B26B 19/14*** | (2006.01) |
| ***B26B 19/04*** | (2006.01) |
| ***B26B 19/42*** | (2006.01) |

(52) U.S. Cl.
CPC ..... *B26B 19/141* (2013.01); *B26B 19/044* (2013.01); *B26B 19/42* (2013.01)

(58) Field of Classification Search
CPC ..... B26B 19/14–19/18
USPC ..... 30/34.2, 43.4–43.6
See application file for complete search history.

(56) References Cited

U.S. PATENT DOCUMENTS

| | | | | |
|---|---|---|---|---|
| 3,962,784 | A * | 6/1976 | Tietjens | 30/43.6 |
| 4,222,168 | A * | 9/1980 | Boiten et al. | 30/43.6 |
| 4,223,437 | A * | 9/1980 | Boiten et al. | 30/43.6 |
| 4,240,199 | A * | 12/1980 | Boiten et al. | 30/43.6 |

(Continued)

FOREIGN PATENT DOCUMENTS

| | | | |
|---|---|---|---|
| EP | 0083952 | A1 | 7/1983 |
| EP | 0094128 | B1 * | 10/1985 |

(Continued)

*Primary Examiner* — Jason Daniel Prone

(57) ABSTRACT

A carrier is adapted for use in a shaving device and includes at least one pair (15) of a cutting element (8) and a hair lifting element (14). At least one of the elements (8, 14) of the pair (15) has a bent shape, wherein the bent element (8, 14) is provided with at least two bending lines (17, 18). The bent shape of the at least one of the elements (8, 14) is such that in a functional arrangement of the elements (8, 14) with respect to each other, edge portions (11, 16) of the elements (8, 14) are located at a distance with respect to each other. Thus, a space (22) is present between the elements (8, 14) at the side of their edge portions (11, 16), which can be used for receiving cut-off hair stubbles which might otherwise hinder a movement of the hair lifting element (14).

12 Claims, 5 Drawing Sheets

(56) References Cited

U.S. PATENT DOCUMENTS

| | | | | | |
|---|---|---|---|---|---|
| 4,258,470 | A | * | 3/1981 | Boiten et al. | 30/43.6 |
| 4,259,781 | A | * | 4/1981 | Boiten et al. | 30/43.6 |
| 4,272,884 | A | | 6/1981 | Tietjens | |
| 4,275,497 | A | | 6/1981 | Engelhardt et al. | |
| 4,281,453 | A | * | 8/1981 | Bakker et al. | 30/43.6 |
| 4,283,849 | A | | 8/1981 | Engelhardt et al. | |
| 4,329,781 | A | * | 5/1982 | Schemmann et al. | 30/34.2 |
| 4,336,650 | A | * | 6/1982 | Gorter | 30/34.2 |
| 4,347,662 | A | * | 9/1982 | Tietjens | 30/34.2 |
| 4,490,906 | A | * | 1/1985 | Haes et al. | 30/34.2 |
| 4,490,907 | A | * | 1/1985 | Benedictus | 30/34.2 |
| 4,545,120 | A | * | 10/1985 | De Vries | 30/34.2 |
| 4,882,840 | A | * | 11/1989 | Tietjens | 30/43.6 |
| 6,502,309 | B2 | | 1/2003 | De Vries et al. | |
| 8,434,233 | B2 | * | 5/2013 | Okabe | 30/43.6 |

FOREIGN PATENT DOCUMENTS

| | | | | |
|---|---|---|---|---|
| EP | 0241082 | A1 | * | 10/1987 |
| EP | 1212176 | B1 | | 6/2002 |
| EP | 1884331 | A1 | * | 2/2008 |
| EP | 2414139 | A1 | * | 2/2012 |
| GB | 2008471 | A | | 6/1979 |
| GB | 2065534 | A | | 7/1981 |
| NL | 9001577 | | | 7/1990 |
| WO | WO 2006048798 | A1 | * | 5/2006 |
| WO | WO 2010089692 | A1 | * | 8/2010 |
| WO | WO 2010113068 | A1 | * | 10/2010 |

* cited by examiner

PRIOR ART

CARRIER FOR A SHAVING DEVICE, COMPRISING PAIRS OF A CUTTING ELEMENT AND A HAIR LIFTING ELEMENT

FIELD OF THE INVENTION

The present invention relates to a carrier which is adapted for use in a shaving device, and which comprises at least one pair of elements, wherein one of the elements of the pair is adapted to function as a cutting element, wherein an edge portion of the cutting element is adapted to contact hairs and to perform a cutting action on hairs when being moved with respect to the hairs, and wherein another of the elements of the pair is adapted to function as a hair lifting element that is intended to precede the cutting element during a movement of the carrier, wherein an edge portion of the hair lifting element is adapted to engage hairs and lift hairs before the hairs are reached by the cutting element, and wherein the hair lifting element is movably arranged with respect to the cutting element.

Furthermore, the present invention relates to a shaving device, comprising at least one carrier as mentioned, and means for driving the carrier such as to perform a movement in a direction in which the cutting element of the at least one pair of elements is preceded by the hair lifting element that is part of the same pair.

BACKGROUND OF THE INVENTION

An example of a shaving device comprising at least one carrier as described above is known from EP 1 212 176. The shaving device is a so-called rotary shaving device, i.e. a shaving device having at least one ring-shaped carrier which is provided with a number of cutting elements, wherein the carrier is driven such as to rotate during operation of the shaving device. In the example known from EP 1 212 176, the shaving device is equipped with three carriers. Each carrier is covered by a cap which is intended to be used for contacting portions of skin to be subjected to a shaving action, and which is provided with openings for letting through hairs from the portions of skin to the cutting elements. It is understood that an important function of the cap is avoiding direct contact between the cutting elements of the carrier and the portions of skin, so that skin damage is prevented.

The shaving device comprises a motor for driving the carriers. Proper use of the shaving device involves movement of the shaving device in such a way that the caps slide over portions of skin. In the process, hairs protruding from the skin are continuously caught in the cap openings and are cut through as soon as they are encountered by the moving cutting elements of the carriers, wherein edges of the cap openings serve as counter cutting edges.

The best shaving results are obtained when the process of cutting through hairs takes place at a level that is as close as possible to the skin. In view of this, it is advantageous to apply elements for engaging hairs and lifting hairs before the hairs are cut through by the cutting elements. EP 1 212 176 discloses blade-shaped hair lifting elements which are provided with a thickened end with an edge, wherein this edge serves for coming into contact with hairs during operation of the shaving device and pulling the hairs further through the cap openings. The hair lifting elements are elastically arranged with respect to the cutting elements, at positions close to the cutting elements. In this way, it is possible to realize a process in which hairs are engaged by the hair lifting elements first, are pulled further through the cap openings under the influence of an elastic movement of the hair lifting elements with respect to the cutting elements, and are cut off under the influence of subsequent contact to the cutting elements. The hair pulling movement of the hair lifting elements may be automatically obtained when these elements are slidably supported by the cutting elements, and when these elements and a supporting surface of the cutting elements have an inclined orientation with respect to a normal orientation of the hairs as they extend through the cap holes.

Although use of the shaving device known from EP 1 212 176 yields good shaving results, there is a need for further improvement. It appears that the function of a hair lifting element is disabled when the element lands on a cut-off hair stubble on the way from a retracted position that is associated with a hair lifting action of the element to a more extended position that is associated with a hair engaging action of the element. As a result, it happens that not all hairs which need to be shaved off are lifted before the actual cutting process takes place, so that a less close shave is obtained. This fail mechanism is also denoted as pollution of the carrier.

Furthermore, there is a need for a light-weight construction of the pairs of the cutting element and the hair lifting element. When the construction of the pairs of elements is relatively heavy, there is a risk that the hair lifting elements cut through the hairs instead of lifting the hairs during a shaving process, which is another factor that leads to a less close shave on the basis of a decreased effectiveness of the hair lifting process. Also, the higher the mass of the hair lifting elements, the more time it takes for these elements to move between the retracted position and the extended position, so that the effectiveness of the hair lifting process is decreased even further.

SUMMARY OF THE INVENTION

It is an object of the present invention to provide a way of improving the shaving results by providing measures for avoiding the above-described process of pollution of the carrier and for realizing a light-weight construction of the pairs of the cutting element and the hair lifting element at the same time. The object is achieved by providing a carrier which is adapted for use in a shaving device, and which is provided with at least one pair of a cutting element and a hair lifting element as described in the foregoing, wherein at least one of the cutting element and the hair lifting element is a bent element having a bent appearance with at least two bending lines which extend across a width of the bent element, and wherein the edge portion of the cutting element and the edge portion of the hair lifting element are located at a distance with respect to each other as a consequence of the at least two bending lines in a functional arrangement of the cutting element and the hair lifting element with respect to each other.

For the sake of clarity, it is noted that a functional arrangement of the cutting element and the hair lifting element with respect to each other is an arrangement in which the elements are suitable to be used in the way as described in the foregoing, i.e. in such a way as to perform a hair lifting process and a hair cutting process, wherein the hair lifting process is performed first in order to ensure a hair cutting process that is performed as close as possible to the skin, or to achieve even that hairs are cut off below skin level, which is the case if the hairs are actually pulled a little from the skin during the hair lifting process.

According to the present invention, at least one of the cutting element and the hair lifting element has a bent shape, wherein the at least one bent element has at least two bending lines which extend across a width of the element. It is noted that the at least two bending lines may be substantially parallel to the edge portion of the bent element. For the sake of completeness, it is noted that the width of an element should be understood such as to be a dimension of the element that is different from both a length of the element, i.e. a dimension of the element that is measured when going from a free end portion of the element to a connecting portion at a side where the element is attached, and a thickness of the element, i.e. a dimension of the element that is measured in a direction of intended movement of the carrier of which the element is part.

The shape of the at least one bent element is chosen such that the edge portion of the hair lifting element and the edge portion of the cutting element are located at a distance with respect to each other. In this configuration, a space is present between the elements at a location where hairs are encountered during a shaving process, and this space allows for an escape of cut-off hair stubbles. It is an achievement of the present invention that the space as mentioned is obtained in a way which does not need to involve an addition of weight. Instead, according to the present invention, realizing an escape of cut-off hair stubbles does not require more than a bent shape of at least one of the elements. Furthermore, having a distance between the elements at the position of their edge portions contributes to realizing a hair lifting path that is sufficiently long for achieving good shaving results.

Hence, when the present invention is applied, at least one of the cutting element and the hair lifting element has a bent shape, wherein it is important that edge portions of the elements are located at a distance with respect to each other. It is possible to have a configuration of the elements which is such that the hair lifting process can be very effective, wherein the elements may be blade-shaped, and wherein there is no need for adding extra weight, as all desired functions of the elements can be realized on the basis of the above-mentioned bent shape.

During a manufacturing process of the carrier according to the present invention, the bent shape of a cutting element and/or a hair lifting element can easily be realized, namely by bending the element, which may be a metal element, in any known manner. The distance between the edge portion of a cutting element and the edge portion of a hair lifting element of one pair of elements can be chosen freely, which is another advantage of the present invention, as this distance is a critical parameter for optimizing the hair lifting process.

With two bending lines extending across a width of the element, the bent element has a stepped appearance. In particular, the bent element may have a shape that is comparable to the shape of a chair with a back, seat and front support. In such a case, it is sufficient if one of the elements is a bent element, wherein a space for allowing cut-off hair stubbles to escape is present between the front support of the chair-shape of the bent element and the other element, and wherein the back of the chair-shape may be resting on the other element.

With reference to the chair terminology used in the preceding paragraph, it is noted that the bent element may comprise three portions which are interconnected through the bending lines, namely a free end portion, which is the front support of the chair-shape, a connecting portion at a side where the element is attached, which is the back of the chair-shape, and an intermediate portion, which is the seat of the chair-shape, and wherein the intermediate portion has another orientation than the two other portions. With respect to the other portions, it is noted that an orientation of the free end portion of the bent element may be substantially the same as an orientation of the connecting portion of the element, but this is not necessary in the chair-shaped embodiment of the bent element.

An orientation of the connecting portion of the bent element may be substantially the same as an orientation of at least a portion of the other element. In that case, it is very well possible for the connecting portion of the bent element to be in gliding contact with the other element.

In one of many possible practical embodiments of the carrier according to the present invention, the hair lifting element is a bent element having a bent appearance with at least two bending lines, wherein each of the bending lines extends across a width of the hair lifting element. In such an embodiment, it may be that the hair lifting element is in gliding contact with the cutting element, at least at the position of one of the bending lines, wherein a bending line which is next, viewed from a side where the hair lifting element is attached to another element of the carrier to the edge portion of the hair lifting element, is located at a distance from the cutting element, and wherein all of a free end portion of the hair lifting element that extends from the latter bending line toward the edge portion of the hair lifting element is located at a distance from the cutting element. In this configuration, it is possible to have a space between the cutting element and the hair lifting element that is large enough for accommodating a cut-off hair stubble, so that such a stubble may escape instead of being in the way of the hair lifting element.

In the embodiment in which the hair lifting element is a bent element, the cutting element may be a straight element. Furthermore, it is possible for the free end portion of the hair lifting element to have a straight appearance as well. In that case, in order to realize optimal functioning of the hair lifting element and the cutting element, it is advantageous if the free end portion of the hair lifting element extends substantially parallel to the cutting element. A general advantage of having a straight appearance of the free portion of the hair lifting element is that the influence of wear on the functioning of the hair lifting element is kept to a minimum.

In practice, a carrier for use in a shaving device is provided with a plurality of pairs of a cutting element and a hair lifting element as described in the foregoing. In such a case, it is preferred if in each pair at least one of the elements has a bent appearance with at least two bending lines which extend across a width of the element, such that the edge portion of the cutting element and the edge portion of the hair lifting element are located at a distance with respect to each other.

The above-described and other aspects of the present invention will be apparent from and elucidated with reference to the following detailed description of a shaving device, a carrier for use in a shaving device, and pairs of a cutting element and a hair lifting element of a carrier according to the present invention.

BRIEF DESCRIPTION OF THE DRAWINGS

The present invention will now be explained in greater detail with reference to the Figures, in which equal or similar parts are indicated by the same reference signs, and in which.

DETAILED DESCRIPTION OF EMBODIMENTS

Figure 1:
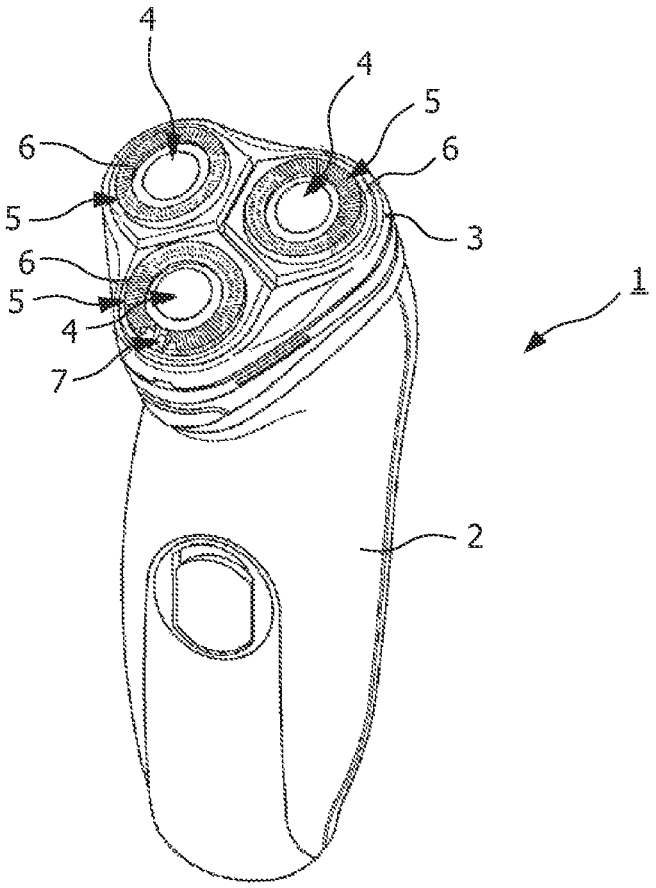
FIG. 1 shows a perspective view of a shaving device.

FIG. 1 shows a general example of a shaving device 1. The shaving device 1 as shown is a rotary shaving device in which a shaving action is realized by using rotating components. Another well-known type of shaving device is a device in which a shaving action is realized by using reciprocating components. For the sake of completeness, it is noted that the present invention is applicable in various types of shaving devices.

The shaving device 1 comprises a housing 2 and a shaving head holder 3. The housing 2 is intended to be taken hold of by a user of the shaving apparatus 1, while the shaving head holder 3 is intended to be positioned against skin which is to be subjected to a shaving action. For the purpose of actually performing a shaving action, a number of units 4 are present in the shaving head holder 3, which are usually referred to as shaving heads 4. In the shown example, the shaving device 1 has three shaving heads 4.

Each shaving head 4 comprises a cap 5 having openings 6 for letting through hairs to an inside of the shaving head 4, and a number of cutting elements (not shown in FIG. 1) which are positioned in the inside of the shaving head 4, and which are adapted to cut off the hairs. In the case of a rotary shaving device 1, the cutting elements are arranged on a carrier (also not shown in FIG. 1), which is driven such as to rotate during operation of the shaving device 1. To this end, the shaving device 1 may be equipped with any suitable driving means such as a small electric motor.

Figure 2:
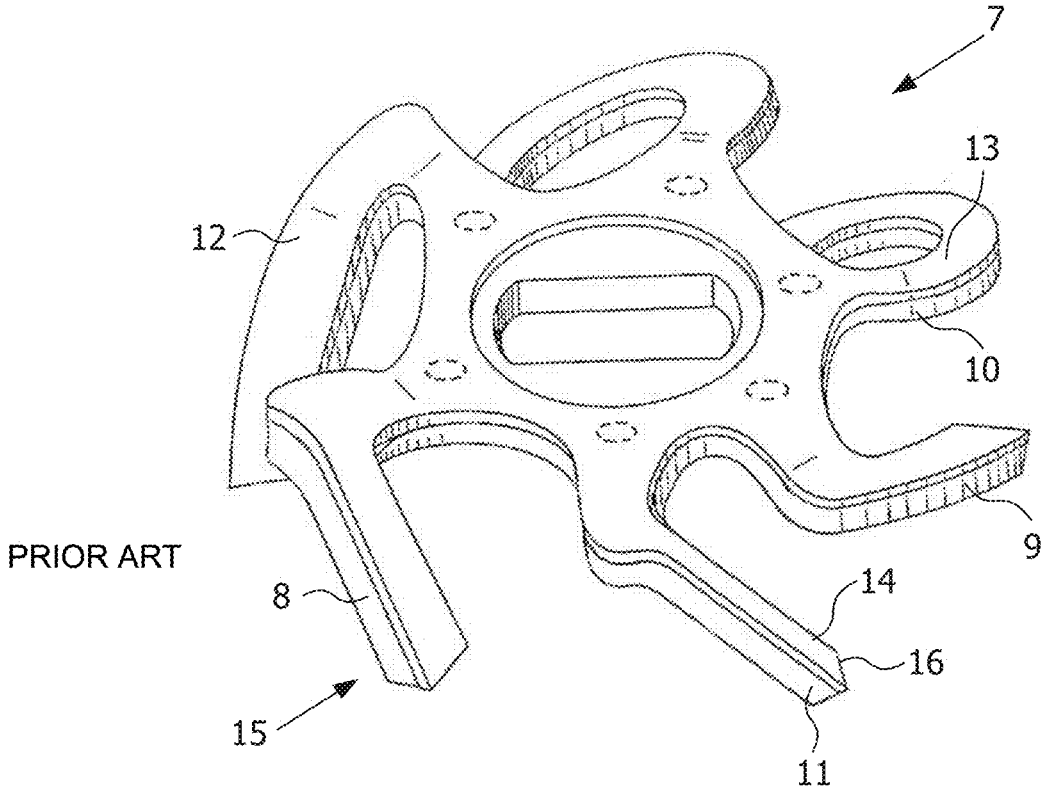
FIG. 2 shows a perspective view of a carrier according to the state of the art, which is provided with a number of pairs of a cutting element and a hair lifting element.

An example of a known type of carrier 7 and the cutting elements 8 which are arranged thereon is shown in FIG. 2. In particular, the carrier 7 is composed of a number of components, including a ring-shaped component 9 having a number of arms 10 arranged along its circumference, wherein end portions of the arms 10 are shaped such as to constitute the cutting elements 8, and wherein outer ends of the arms 10 are shaped such as to constitute cutting edges 11 of the cutting elements 8.

Besides the component 9 having the arms 10 and the cutting elements 8 as described in the foregoing, the carrier 7 comprises another ring-shaped component 12 on which a number of arms 13 are arranged. End portions of these arms 13 are intended to be used as hair lifting elements 14 during operation of the shaving device 1. In view of this, in the assembled state of the carrier 7, the cutting elements 8 and the hair lifting elements 14 form mixed pairs 15, i.e. one cutting element 8 is associated with one hair lifting element 14. In this configuration, the hair lifting elements 14 lie against the cutting elements 8. Furthermore, the hair lifting elements 14 are slidable with respect to the cutting elements 8 due to elastic properties of the arms 13 of the hair lifting elements 14. For the sake of completeness, it is noted that the hair lifting elements 14 are arranged in front of the cutting elements 8 as seen in a direction in which the carrier 7 is intended to be moved. Furthermore, it is noted that metal is a suitable material for the ring-shaped components 9, 12 having the cutting elements 8 and the hair lifting elements 14, respectively.

The operation of a shaving device 1 having one or more shaving heads 4 in which the carrier 7 as shown in FIG. 2 is arranged is as follows. When the shaving device 1 is used for performing a shaving action, the caps 5 of the shaving heads 4 are moved across a portion of skin to be subjected to the shaving action by a user of the shaving device 1, and the carriers 7 are driven such as to rotate at their position right behind the caps 5. Due to the movement of the shaving heads 4 with respect to the skin, there is a continuous process of hairs getting trapped inside the cap openings 6 and being encountered by the pairs 15 of a cutting element 8 and a hair lifting element 14. In the process, the hair is encountered by the hair lifting element 14 first, wherein an outer edge 16 of the hair lifting element 14 penetrates the hair to some extent. In any case, the outer edge 16 of the hair lifting element 14 is not adapted to cut through the hair, but only to enter the hair over a small distance which is smaller than the diameter of the hair.

Once a hair is caught by a hair lifting element 14, the ongoing rotary movement of the carrier 7 and the components arranged thereon causes the hair lifting element 14 to slide along the cutting element 8 and perform a retracting movement over some distance. To this end, the cutting elements 8 and the hair lifting elements 14 have a defined inclined orientation as shown in FIG. 2. A hair which is caught keeps the hair lifting element 14 temporarily in a fixed place while the associated cutting element 8 presses against the hair lifting element 14 in the rotary movement. Due to the elastic properties of the arm 13 of the hair lifting element 14, this causes the hair lifting element 14 to perform a retracting movement, and due to the engagement of the hair lifting element 14 with a hair, this retracting movement is more or less in a direction in which the hair extends. In the process, the hair is lifted to some extent, inter alia owing to natural elasticity of the skin, and gets cut off once the hair lifting element 14 is retracted to such extent that the cutting edge 11 of the cutting element 8 reaches the hair.

Figure 3:
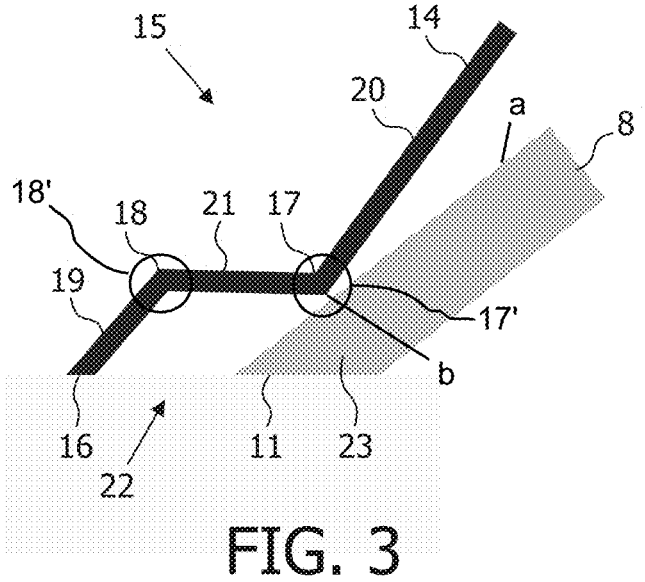
FIG. 3 diagrammatically shows a first embodiment of a pair of a cutting element and a hair lifting element according to the present invention.

In principle, a shaving action can also be performed with the use of carriers 7 which are only equipped with cutting elements 8, wherein the hair lifting elements 14 are omitted. However, applying the hair lifting elements 14 leads to much better shaving results, as the hairs may be cut off at a level which is closer to the skin. The present invention is especially applicable in the field of carriers 7 having at least one pair 15 of a cutting element 8 and a hair lifting element 14, and will now be explained on the basis of FIGS. 3-8. In FIG. 3, a first embodiment of a pair 15 of a cutting element 8 and a hair lifting element 14 according to the present invention is diagrammatically shown. In this embodiment, the hair lifting element 14 has a bent shape, wherein two bending lines 17, 18 at which respective bent portions 17', 18' are formed in the hair lifting element 14, which extend across a width of the hair lifting element 14, substantially parallel to the outer edge 16. On the basis of the presence of the two bending lines 17, 18, three portions 19, 20, 21 can be discerned in the hair lifting element 14, namely a free end portion 19, a connecting portion 20 at a side where the hair lifting element 14 is attached, and an intermediate portion 21.

An important and advantageous consequence of the bent shape of the hair lifting element 14 is that the outer edge 16 of the hair lifting element 14 is positioned at a distance from the cutting edge 11 of the cutting element 8, which distance is related to a length of the intermediate portion 21. In the first embodiment, gliding contact is established between an inclined surface "a" of the cutting element 8 and a surface "b" of the hair lifting element 14 that is formed opposite a bending line 17 between the connecting portion 20 and the intermediate portion 21 of the hair lifting element 14.

In FIG. 3, the cutting edge 11 of the cutting element 8 and the outer edge 16 of the hair lifting element 14 are shown at a substantially equal level. This positioning of the elements 8, 14 corresponds to a starting position for encountering a hair to be cut through in a shaving process. In this position, a hair receiving space 22 is present underneath the intermediate portion 21 of the hair lifting element 14, and between the free end portion 19 of the hair lifting element 14 and a free end portion 23 of the cutting element 8.

Figure 4:
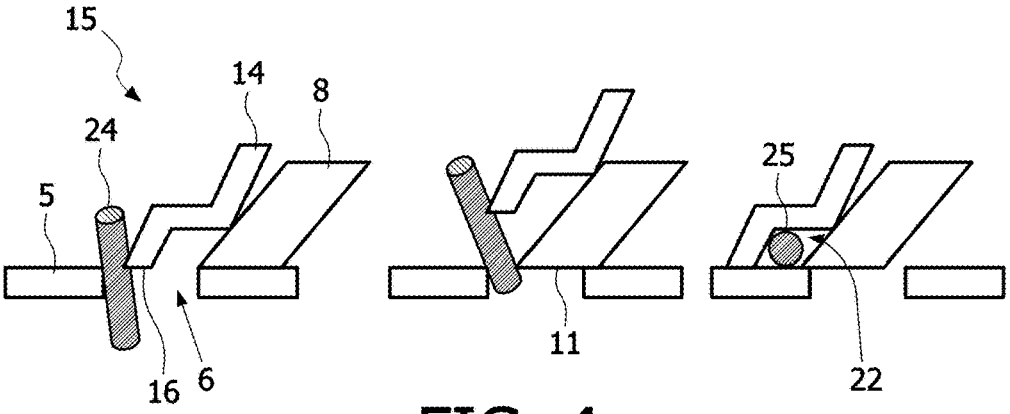
FIG. 4 serves to illustrate the way in which the cutting element and the hair lifting element shown in FIG. 3 are used, wherein three stages in a hair lifting and cutting process are diagrammatically shown.

In FIG. 4, a hair lifting and cutting process as may be performed by means of the pair 15 of the cutting element 8 and the hair lifting element 14 according to the first embodiment of the present invention is illustrated. In particular, three stages of the process are shown.

In a first stage, as shown on the left side of the Figure, the elements 8, 14 are in the starting position, and a hair 24 extending through an opening 6 in a cap 5 for covering the carrier 7 of which the elements 8, 14 are part is encountered by the outer edge 16 of the hair lifting element 14. In the ongoing movement of the elements 8, 14, the outer edge 16 of the hair lifting element 14 penetrates the hair 24 to some extent, and the hair 24 is lifted, wherein the hair lifting element 14 glides along the cutting element 8.

In a second stage, as shown in the middle of FIG. 4, the cutting edge 11 of the cutting element 8 reaches the hair 24. Subsequently, the hair 24 is subjected to a cutting action, while the hair 24 is kept in the lifted position. Once the hair 24 has been cut through, the cut-off hair stubble 25 falls off the outer edge 16 of the hair lifting element 14, and the hair lifting element 14 moves back to the starting position.

In a third stage, as shown on the right side of FIG. 4, the elements 8, 14 are in the starting position again. It may happen that a cut-off hair stubble 25 remains near the cutting edge 11 of the cutting element 8. However, this will not constitute a hindrance for the hair lifting element 14 to return to the starting position, as the stubble 25 may be accommodated inside the hair receiving space 22, as shown in FIG. 4. Hence, due to the stepped shape of the hair lifting element 14, the hair lifting process may be performed with constant effectiveness, resulting in excellent shaving results.

It follows from the foregoing that when the present invention is applied, a decrease of the effectiveness of the hair lifting process is prevented. In this respect, an advantageous aspect of the present invention is the fact that no additional elements are needed for achieving this result. Providing at least one of the cutting element 8 and the hair lifting element 14 with an appropriate bent shape is all that is needed. Thus, a light-weight construction of the carrier 7 according to the present invention is possible, which involves advantageous dynamic behavior and other benefits. Furthermore, an additional step of bending of at least one of the elements 8, 14 during a manufacturing process of the carrier 7 does not constitute a noteworthy complication of this manufacturing process.

Alternative embodiments of a pair 15 of a cutting element 8 and a hair lifting element 14 according to the present invention are diagrammatically shown in FIGS. 5-8.

Figure 5:
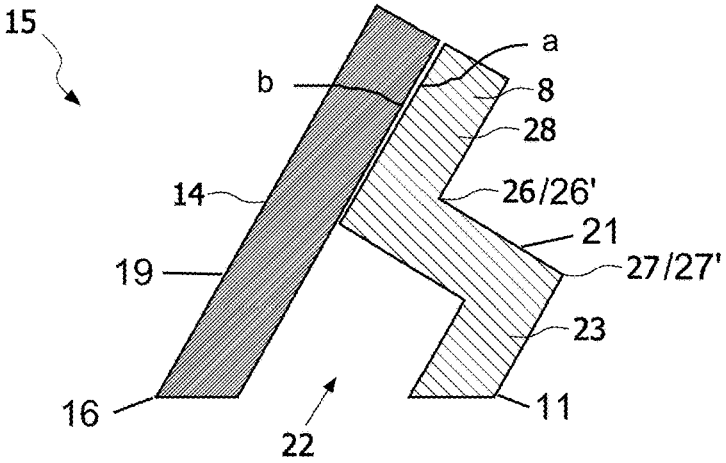
FIG. 5 diagrammatically shows a second embodiment of a pair of a cutting element and a hair lifting element according to the present invention.
Figure 6:
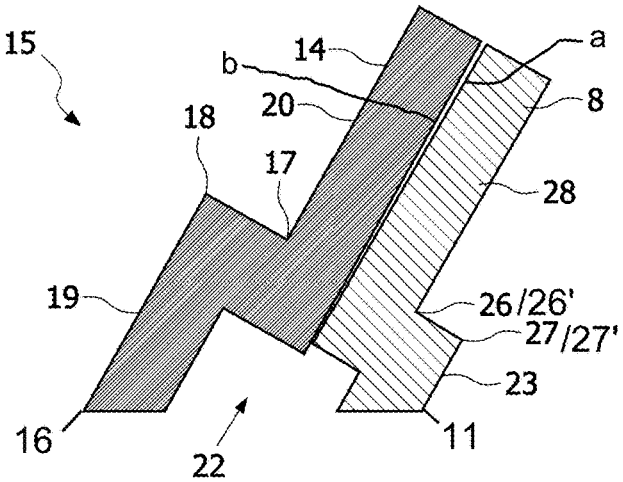
FIG. 6 diagrammatically shows a third embodiment of a pair of a cutting element and a hair lifting element according to the present invention.

The hair lifting element 14 does not necessarily need to be the element 8, 14 that is provided with bending lines 17, 18. In a second embodiment as shown in FIG. 5, the cutting element 8 has a bent appearance, whereas the hair lifting element 14 has a straight appearance. It is also possible that both elements 8, 14 are provided with two bending lines 17, 18, 26, 27, wherein, in a general sense, the shape of one of the elements 8, 14 is a mirror shape of another of the elements 8, 14. This possibility is shown in FIG. 6.

Figure 7:
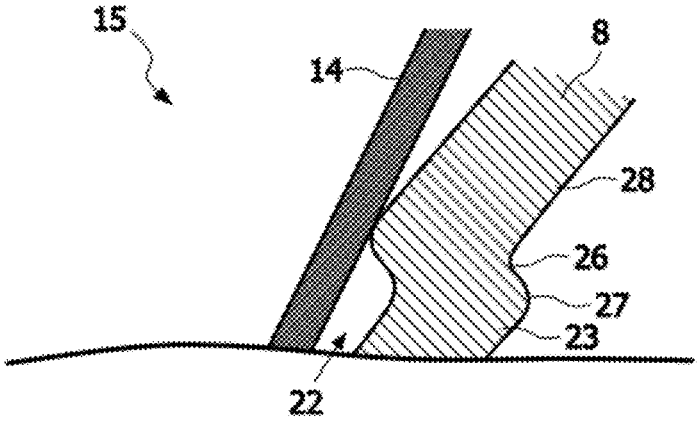
FIG. 7 diagrammatically shows a fourth embodiment of a pair of a cutting element and a hair lifting element according to the present invention.

In the second embodiment as shown in FIG. 5, a connecting portion 28 of the cutting element 8 has an orientation that is substantially the same as an orientation of the hair lifting element 14. In this way, it is achieved that gliding contact of the hair lifting element 14 to the cutting element 8 is realized over a relatively large area. Nevertheless, an alternative to this configuration is also possible within the scope of the present invention, as can be derived from FIG. 7. Furthermore, it is noted that a connecting portion 20, 28 of an element 8, 14 and a free end portion 19, 23 of the same element 8, 14 may have the same orientation when two bending lines 17, 18, 26, 27 are present in the element 8, 14, as shown in FIGS. 5-7, but this is not necessary.

Figure 8:
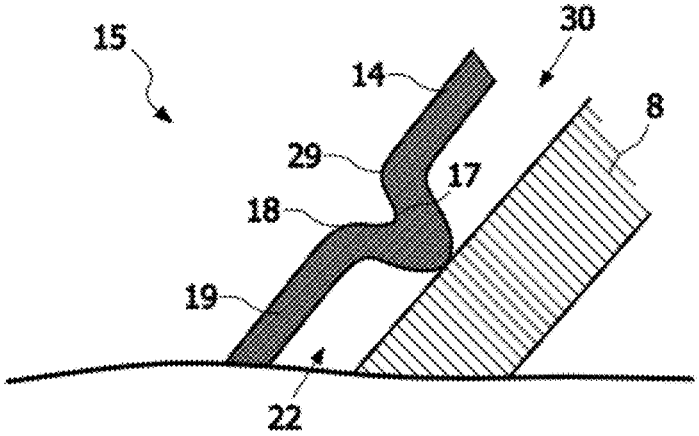
FIG. 8 diagrammatically shows a fifth embodiment of a pair of a cutting element and a hair lifting element according to the present invention.

FIG. 8 shows an alternative embodiment of a pair 15 of a cutting element 8 and a hair lifting element 14 according to the present invention, in which the hair lifting element 14 is provided with as many as three bending lines 17, 18, 29. In particular, in this way, a V-shaped portion 30 is obtained in the hair lifting element 14, which serves for keeping the other portions of the hair lifting element 14, including the free end portion 19, at a distance from the cutting element 8, so that at least the hair receiving space 22 is realized in this embodiment.

Figure 9:
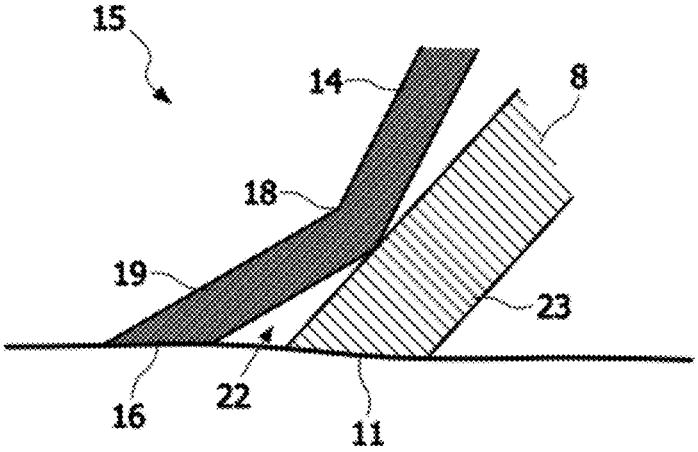
FIG. 9 diagrammatically shows a first alternative embodiment of a pair of a cutting element and a hair lifting element.
Figure 10:
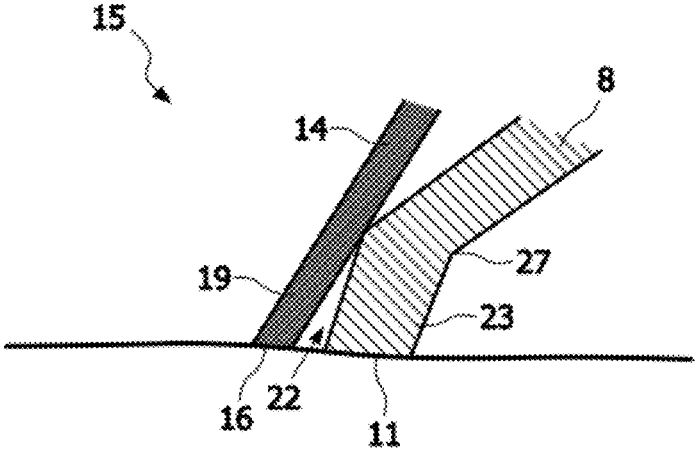
FIG. 10 diagrammatically shows a second alternative embodiment of a pair of a cutting element and a hair lifting element.

It is noted that in principle, the number of bending lines 17, 18, 26, 27 of an element 8, 14 does not necessarily need to be at least two, but may also be one. FIGS. 9 and 10 illustrate embodiments in which only one of the elements 8, 14 is bent, and wherein the bent element 8, 14 only comprises one bending line 18, 27. In the example shown in FIG. 9, the hair lifting element 14 is the bent element, whereas in the example shown in FIG. 10, the cutting element 8 is the bent element. In both embodiments, orientations of free end portions 19, 23 of the elements 8, 14 are chosen such that a diverging configuration of these portions 19, 23 is obtained, as seen in a direction from a position where the elements 8, 14 are contacting each other towards outer edges 11, 16 of the elements 8, 14. On the basis of this diverging configuration, the hair receiving space 22 which plays a role in preventing a decrease of effectiveness of the hair lifting process is present between the end portions 19, 23 of the elements 8, 14.

It will be clear to a person skilled in the art that the scope of the present invention is not limited to the examples discussed in the foregoing, but that several amendments and modifications thereof are possible without deviating from the scope of the present invention as defined in the attached claims. While the present invention has been illustrated and described in detail in the Figures and the description, such illustration and description are to be considered illustrative or exemplary only, and not restrictive. The present invention is not limited to the disclosed embodiments.

Variations to the disclosed embodiments can be understood and effected by a person skilled in the art in practicing the claimed invention, from a study of the Figures, the description and the attached claims. In the claims, the word "comprising" does not exclude other steps or elements, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the present invention.

The present invention can be summarized as follows. A carrier 7 is adapted for use in a shaving device 1, and comprises at least one pair 15 of elements 8, 14. One of the elements 8, 14 of the pair 15 is adapted to function as a cutting element 8, wherein an edge portion 11 of the cutting element 8 is adapted to contact hairs 24 and to perform a cutting action on hairs 24 when being moved with respect to the hairs 24, and another of the elements 8, 14 of the pair 15 is adapted to function as a hair lifting element 14 that is intended to precede the cutting element 8 during a movement of the carrier 7, wherein an edge portion 16 of the hair lifting element 14 is adapted to engage hairs 24 and lift hairs 24 before the hairs 24 are reached by the cutting element 8. Furthermore, the hair lifting element 14 is movably arranged with respect to the cutting element 8, so that the hair lifting element 14 is actually capable of lifting hairs 24 in front of the cutting element 8.

According to the present invention, at least one of the cutting element 8 and the hair lifting element 14 has a bent shape, wherein the bent element 8, 14 is provided with at least two bending lines 17, 18, 26, 27, 29 which extend across a width of the element 8, 14. The bent shape of the at least one of the elements 8, 14 is such that in a functional arrangement of the elements 8, 14 with respect to each other, the edge portions 11, 16 are located at a distance with respect to each other. Thus, a space 22 is present between the elements 8, 14 at the side of their edge portions 11, 16, which space 22 can be used for receiving cut-off hair stubbles 25 which might otherwise hinder a movement of the hair lifting element 14.

The invention claimed is:

1. A carrier adapted for use in a shaving device comprising a shaving head having openings for receiving hairs to be cut, said carrier having a plurality of pairs of elements extending therefrom for motion in a predetermined direction within said shaving head, each of said pairs of elements comprising:

a) a first element having an end portion with a hair-cutting edge for cooperating with a lateral surface of the shaving head to cut hairs passing through the openings, said end portion having a first surface inclined relative to the lateral surface when incorporated in the shaving device; and b) a second element elastically-supported relative to the first element and including:

i) an end portion with a hair-lifting edge for, in operation, engaging the hairs to be cut before said hairs are encountered by the hair-cutting edge of the first element; and ii) a second surface arranged for, in operation, sliding along the first surface to effect lifting of the engaged hairs before being encountered by the hair-cutting edge of the first element;

at least one of the first and second elements including first and second successive transverse bending lines, spaced from a respective one of the hair-cutting edge or the hair-lifting edge by first and second distances measured along a length of said at least one element, for defining ends of an intermediate portion of said at least one element extending between respective first and second bent portions formed at said first and second successive transverse bending lines;

said intermediate portion maintaining a gap between the end portions of said first and second elements to provide a hair receiving space during operation.

2. The carrier according to claim 1 where the second surface comprises a surface of the second bent portion of the at least one element.

3. The carrier according to claim 2 where the at least one of the first and second elements includes a third successive transverse bending line where the at least one of the first and second elements is bent in a direction extending generally along the other one of the first and second elements.

4. The carrier according to claim 1 where each of the first and second successive transverse bending lines extends substantially parallel to the respective one of the hair-cutting edge or the hair-lifting edge.

5. The carrier according to claim 1 where the second surface comprises a portion of the second element extending substantially parallel to the first surface.

6. The carrier according to claim 5 where the first and second surfaces form a predetermined inclination relative to said lateral surface of the shaving head when the carrier is incorporated in the shaving device.

7. The carrier according to claim 1 where each of the first and second elements includes at least first and second ones of said successive transverse bending lines, each of said first and second elements being bent at said respective first bending line in a first direction toward the other one of the first and second elements and being bent at said respective second bending line in a second direction to form said respective sliding surfaces to facilitate said lifting of the hairs, an intermediate portion of each of said first and second elements extending between the respective first and second bending lines to collectively maintain said gap for providing said hair receiving space.

8. A shaving device for removing hairs from skin, said shaving device comprising at least one shaving head including an external cutting member having a surface disposed for contacting the skin and openings arranged to receive the hairs, said at least one shaving head comprising a carrier having a plurality of pairs of elements extending therefrom for motion in a predetermined direction within said shaving head, each of said pairs of elements comprising:

a) a first element having an end portion with a hair-cutting edge for, in operation, cooperating with a lateral inner surface of the shaving head to cut hairs passing through the openings, said end portion having a first surface inclined relative to the lateral surface; and b) a second element elastically-supported relative to the first element and including:

i) an end portion with a hair-lifting edge for, in operation, engaging the hairs to be cut before said hairs are encountered by the hair-cutting edge of the first element; and ii) a second surface arranged for, in operation, sliding along the first surface to effect lifting of the engaged hairs before being encountered by the hair-cutting edge of the first element;

at least one of the first and second elements including first and second successive transverse bending lines spaced from a respective one of the hair-cutting edge or the hair-lifting edge by first and second distances measured along a length of said at least one element for defining ends of an intermediate portion of said at least one element extending between respective first and second bent portions formed at said first and second successive transverse bending lines;

said intermediate portion maintaining a gap between the end portions of said first and second elements to provide a hair receiving space during operation.

9. A shaving device according to claim 8 where the second surface comprises a portion of the second element extending substantially parallel to the first surface.

10. A shaving device according to claim 9 where the first and second surfaces form a predetermined inclination relative to said lateral internal surface of the shaving head.

11. A shaving device according to claim 8 where the second surface comprises a surface of the second bent portion of the at least one element.

12. A shaving device according to claim 8 where the first and second successive transverse bending lines extend substantially parallel to the respective one of the hair-cutting edge or the hair-lifting edge.

* * * * *